US007079092B2

(12) United States Patent
Tanghe et al.

(10) Patent No.: US 7,079,092 B2
(45) Date of Patent: Jul. 18, 2006

(54) ORGANIC LIGHT-EMITTING DIODE (OLED) PRE-CHARGE CIRCUIT FOR USE IN A COMMON ANODE LARGE-SCREEN DISPLAY

(75) Inventors: Gino Tanghe, Merkem (BE); Robbie Thielemanns, Nazareth (BE)

(73) Assignee: Barco NV, Kortrijk (BE)

( * ) Notice: Subject to any disclaimer, the term of this patent is extended or adjusted under 35 U.S.C. 154(b) by 323 days.

(21) Appl. No.: 10/424,030

(22) Filed: Apr. 25, 2003

(65) Prior Publication Data

US 2004/0233148 A1 Nov. 25, 2004

(51) Int. Cl.
*G09G 3/30* (2006.01)
*G09G 3/32* (2006.01)

(52) U.S. Cl. ..... 345/76; 345/82; 315/169.3

(58) Field of Classification Search ..... 345/76–83; 315/169.3; G09G 3/30, 3/32
See application file for complete search history.

(56) References Cited

U.S. PATENT DOCUMENTS

| | | | | |
|---|---|---|---|---|
| 6,310,589 | B1 | 10/2001 | Nishigaki | |
| 6,366,116 | B1 | 4/2002 | Juang | |
| 6,369,786 | B1 | 4/2002 | Suzuki | |
| 6,473,064 | B1 | 10/2002 | Tsuchida | |
| 6,486,607 | B1 | 11/2002 | Yeunan | |
| 6,667,580 | B1 * | 12/2003 | Kim et al. | 315/169.3 |
| 2003/0160744 | A1 * | 8/2003 | Yoshida et al. | 345/82 |
| 2004/0155844 | A1 * | 8/2004 | Stopa | 345/82 |

FOREIGN PATENT DOCUMENTS

| | | | |
|---|---|---|---|
| EP | 1274065 | A2 | 1/2003 |
| JP | 2001296837 | A * | 10/2001 |

* cited by examiner

*Primary Examiner*—Alexander Eisen
(74) *Attorney, Agent, or Firm*—Barnes & ThornburgLLP

(57) ABSTRACT

The present invention is a pre-charge circuit integrated within the drive circuitry of a common anode, passive matrix, large-screen organic light-emitting diode (OLED) display device for overcoming the inherent capacitance characteristics $C_{OLED}$ of the OLED devices therein. More specifically, a first pre-charge circuit of the present invention includes a MOSFET device integrated within the normal drive circuitry for applying a pre-charge voltage to the cathode of a given OLED device just prior to the desired "on" time, thereby overcoming $C_{OLED}$ rapidly. A second pre-charge circuit of the present invention integrates within the normal drive circuitry a method of connecting the anode of a given OLED device to a positive voltage while concurrently connecting the cathode to ground just prior to the desired on time, thereby overcoming $C_{OLED}$ rapidly. A third pre-charge circuit of the present invention includes an additional current source for supplying current over and above the normal operating current, which is activated just prior to the desired on time, thereby overcoming $C_{OLED}$ rapidly. Finally, in a fourth pre-charge circuit of the present invention, a single current source is used that supplies a high current value just prior to the desired on time. Once the capacitor is charged, the output of this current source rapidly drops to the normal constant operating current.

21 Claims, 6 Drawing Sheets

ORGANIC LIGHT-EMITTING DIODE (OLED) PRE-CHARGE CIRCUIT FOR USE IN A COMMON ANODE LARGE-SCREEN DISPLAY

TECHNICAL FIELD OF THE INVENTION

The present invention relates to the drive circuitry of a common anode, passive matrix large-screen organic light-emitting diode (OLED) display. More particularly, this invention relates to a pre-charge circuit for optimizing performance.

BACKGROUND OF THE INVENTION

Organic light-emitting diode (OLED) technology incorporates organic luminescent materials that, when sandwiched between electrodes and subjected to a DC electric current, produce intense light of a variety of colors. These OLED structures can be combined into the picture elements or pixels that comprise a display. OLEDs are also useful in a variety of applications as discrete light-emitting devices or as the active element of light-emitting arrays or displays, such as flat-panel displays in watches, telephones, laptop computers, pagers, cellular phones, calculators, and the like. To date, the use of light-emitting arrays or displays has been largely limited to small-screen applications such as those mentioned above.

Demands for large-screen display applications possessing higher quality and higher resolution has led the industry to turn to alternative display technologies that replace older LED and liquid crystal displays (LCDs). For example, LCDs fail to provide the bright, high light output, larger viewing angles, and high resolution and speed requirements that the large-screen display market demands. By contrast, OLED technology promises bright, vivid colors in high resolution and at wider viewing angles. However, the use of OLED technology in large-screen display applications, such as outdoor or indoor stadium displays, large marketing advertisement displays, and mass-public informational displays, is still in the development stage.

Several technical challenges exist relating to the use of OLED technology in a large-screen application. One such challenge is that OLED displays are expected to offer a wide dynamic range of colors, contrast, and light intensity depending on various external environmental factors including ambient light, humidity, and temperature. For example, outdoor displays are required to produce more white color contrast during the day and more black color contrast at night. Additionally, light output must be greater in bright sunlight and lower during darker, inclement weather conditions. The intensity of the light emission produced by an OLED device is directly proportional to the amount of current driving the device. Therefore, the more light output needed, the more current is fed to the pixel. Accordingly, less light emission is achieved by limiting the current to the OLED device.

A pixel, by definition, is a single point or unit of programmable color in a graphic image. However, a pixel may include an arrangement of sub-pixels, for example, red, green, and blue sub-pixels. There are two basic circuit configurations for driving these sub-pixels, namely, a common cathode configuration and a common anode configuration. These configurations differ as to whether the three sub-pixels are addressed via a common cathode line or addressed via a common anode line, respectively. Accordingly, in the common cathode configuration, the cathodes of the three sub-pixels are electrically connected and addressed in common; in the common anode configuration, the anodes of the three sub-pixels are electrically connected and addressed in common.

Conventional OLED displays typically use the common cathode configuration. In a typical common cathode drive circuit, a current source is arranged between each individual anode and a positive power supply, while the cathodes are electrically connected in common to ground. Consequently, the current and voltage are not independent of one another, and small voltage variations result in fairly large current variations, having the further consequence of light output variations. Furthermore, in the common cathode configuration, the constant current source is referenced to the positive power supply, so again any small voltage variation will result in a current variation. For these reasons, the common cathode configuration makes precise control of light emission, which is dependent upon precise current control, more difficult.

By contrast, in a typical common anode drive circuit, a current source is arranged between each individual cathode and ground, while the anodes are electrically connected in common to the positive power supply. As a result, the current and voltage are completely independent of one another, and small voltage variations do not result in current variations, thereby eliminating the further consequence of light output variations. Furthermore, in the common anode configuration, the constant current source is referenced to ground, which does not vary, thereby eliminating any current variations due to its reference. For these reasons, the common anode configuration lends itself to the precise control of light emission needed in a large-screen display application.

Another consideration in a large-screen display application using OLED technology is the physical size of the pixel. A larger emission area is more visible and lends itself to achieving the required wide dynamic range of colors, contrast, and light intensity. Consequently, an OLED device structure having a larger area than OLED structures of conventional small-screen displays is desirable. In a small-screen application, the pixel pitch is typically 0.3 mm or less and the pixel area is, for example, only 0.1 $mm^2$. By contrast, in a large-screen application, the pixel pitch may be 1.0 mm or greater, thereby allowing the pixel area to be as large as 0.3 to 50 $mm^2$ (pitch varies up to 10 mm or more with fill factors of 50%). However, a consequence of the larger device area is the relatively high inherent capacitance ($C_{OLED}$) of the larger OLED device as compared with small OLED structures. Due to this high inherent capacitance, in operation, an additional amount of charge time is required to reach the OLED device working voltage. This charge time limits the on/off rate of the device and thus adversely affects the overall display brightness and performance.

OLED pre-charge circuits have been developed and integrated into the existing drive circuitry to help overcome the capacitance characteristic of OLEDs within a graphics display device. For example, U.S. Pat. No. 6,323,631, entitled, "Constant current driver with auto-clamped pre-charge function," describes a constant current driver with auto-clamped pre-charge function that includes a reference bias generator and a plurality of constant current driver cells, each being connected to the reference bias generator to form a respective current mirror. Each constant current driver cell has a switch transistor, a current output transistor, and a pre-charge transistor. When a constant current is output from the current output transistor for driving an OLED, the pre-charge transistor is turned on to provide a drain to source current as an additional large current for rapidly pre-charging the OLED until the gate to source voltage of the pre-charge transistor is smaller than the threshold voltage. While the pre-charge function of the '631 patent suitably serves to rapidly pre-charge the OLED devices and thereby optimize performance, the pre-charge function of the '631 patent is designed for use in a common cathode drive circuit and is therefore not suitable for use in the common anode drive circuit of a large-screen OLED display device. A further drawback of the pre-charge function of the '631 patent is that it is designed to handle the $C_{OLED}$ value associated with a small pixel area, such as 0.1 $mm^2$, and is therefore not able to overcome the larger $C_{OLED}$ value associated with a large pixel area.

It is therefore an object of the invention to provide a pre-charge circuit suitable for use in a large-screen OLED display arranged in a common anode configuration.

It is another object of this invention to provide a pre-charge circuit suitable to overcome the large $C_{OLED}$ value associated with the large-area OLED device of a large-screen OLED display arranged in a common anode configuration, thereby optimizing performance.

It is yet another object of this invention to provide a pre-charge circuit that eliminates the effects of varying OLED device characteristics, such as capacitance, due to manufacturing process variations.

SUMMARY OF THE INVENTION

The present invention provides a drive circuitry for a common anode, passive matrix, organic light-emitting diode (OLED) display comprising at least one OLED having an anode and a cathode, the cathode of the OLED being coupled in series to a first current source and a first switching means. The drive circuitry comprises means for pre-charging the at least one OLED before closing the switching means.

The means for pre-charging the at least one OLED may comprise a second switching means. The second switching means may comprise an active switch device, which may comprise a MOSFET. The MOSFET may be an NMOS transistor device having suitable voltage and current ratings for pre-charging the at least one OLED.

The second switching means may be coupled in a branch in parallel over the first current source. If the second switching means comprises a MOSFET, the MOSFET having a gate, the source may be electrically connected to a pre-charge voltage. The MOSFET may also have a drain which is electrically connected to the cathode of the OLED.

The second switching means may comprise a first switch device suitable for coupling the cathode of the OLED to the ground, and a second switch device suitable for coupling; the anode of the OLED to a voltage supply substantially corresponding to the normal operating voltage of the OLED. The first switch device and the second switch device may be active switch devices. The active switch devices may be MOSFET transistors having suitable voltage and current ratings for pre-charging the at least one OLED.

The means for pre-charging the at least one OLED may furthermore comprise a second current source coupled in parallel over the first current source. The second current source may be suitable for supplying a current between 50 and 800 mA, preferably between 100 and 600 mA. The second current source may be substantially identical to the first current source, or it may be different, for example the second current source may be suitable for supplying a current between 2 and 4 times the current supplied by the first current source.

The first current source may be a current source device capable of modifying its output current by selecting either one of a first or a second current reference.

The present invention also provides an arrangement comprising an array of OLEDs, each OLED having an anode common with other OLED's of the array and a cathode, and drive circuitry according to the present invention.

The present invention furthermore provides a common anode, passive matrix, organic light-emitting diode (OLED) display comprising an array of OLEDs, each OLED having an anode and a cathode, the display comprising drive circuitry according to the present invention.

The present invention also provides a method for pre-charging an organic light-emitting diode (OLED) of a common anode, passive matrix OLED display prior to a desired ON-time of the OLED, the method comprising charging the OLED immediately prior to the desired ON-time. The charging may be done by applying a pre-charge voltage to the cathode of the OLED prior to the desired ON-time. Alternatively, it may be done by applying a first voltage level to the anode of the OLED while pulling the cathode of the OLED to a second voltage level, the difference between the first and the second voltage being equal to a desired pre-charge voltage. In this latter case, the first voltage level may be equal to the desired pre-charge voltage, and the second voltage level may be the ground level. According to still another alternative embodiment, the charging may be done by supplying additional current to the OLED prior to the desired ON-time.

The pre-charge voltage may be substantially equal to a normal operating voltage of the OLED during ON-time. At low light output extra gray scales may be obtained by selectively switching two current sources.

These and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

BRIEF DESCRIPTION OF THE DRAWINGS

FIG. 2A illustrates a schematic diagram of an OLED drive circuit that is representative of a drive circuit of a single OLED within the OLED array circuit of

FIG. 1.

FIG. 6 illustrates a schematic diagram of an OLED pre-charge circuit in accordance with a fourth embodiment of the present invention.

Figure 1:
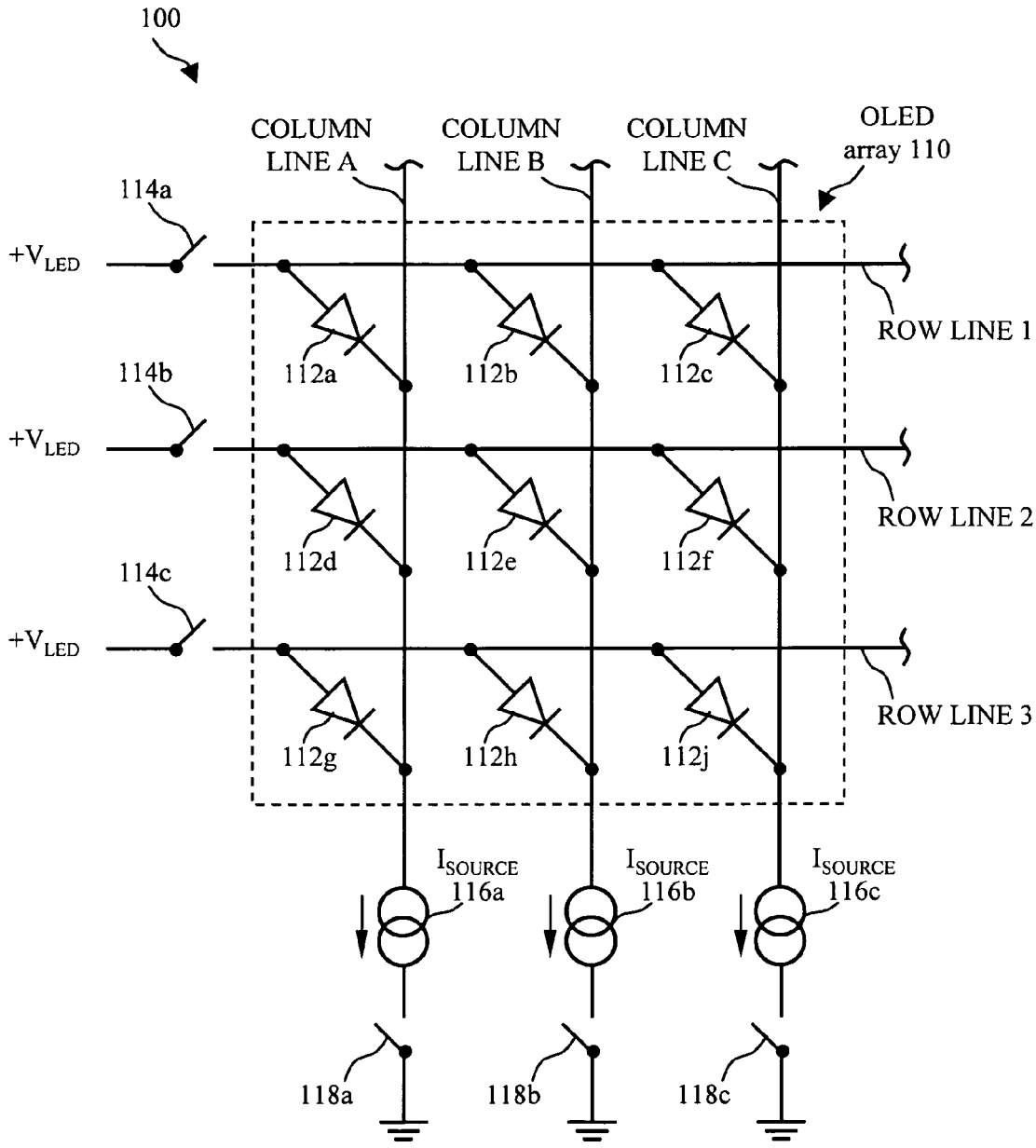
FIG. 1 illustrates a schematic diagram of an OLED array circuit that is representative of a portion of a common anode, passive matrix, large-screen OLED array and associated drive circuit.

In the different figures, the same reference figures refer to the same or analogous elements.

DESCRIPTION OF ILLUSTRATIVE EMBODIMENTS

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes.

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

It is to be noticed that the term "comprising", used in the claims, should not be interpreted as being restricted to the means listed thereafter; it does not exclude other elements or steps. Thus, the scope of the expression "a device comprising means A and B" should not be limited to devices consisting only of components A and B. It means that with respect to the present invention, the only relevant components of the device are A and B.

The present invention will mainly be described with reference to a single display but the present invention is not limited thereto. For instance, the display may be extendable, e.g. via tiling, to form larger arrays. Hence, the present invention may also include assemblies of pixel arrays, e.g. they may be tiled displays and may comprise modules made up of tiled arrays which are themselves tiled into supermodules. Thus, the word display relates to a set of addressable pixels in an array or in groups of arrays. Several display units or "tiles" may be located adjacent to each other to form a larger display, i.e. multiple display element arrays are physically arranged side-by-side so that they can be viewed as a single image.

In one aspect of the present invention a pre-charge circuit is provided which may be integrated within the drive circuitry of a common anode, passive matrix, OLED display device in order to overcome the inherent capacitance characteristic, $C_{OLED}$, of the OLED devices therein. The display may be a large-screen display. More specifically, in an aspect of the present invention a first pre-charge circuit of the present invention applies a pre-charge voltage to the cathode of a given OLED device just prior to the desired "on" time, thereby charging the OLED device rapidly. A second pre-charge circuit of the present invention applies a pre-charge voltage to the anode of a given OLED device while concurrently pulling the cathode to ground just prior to the desired on time, thereby charging the OLED device rapidly. A third pre-charge circuit of the present invention simply supplies additional current to the OLED device just prior to the desired on time, thereby charging the OLED device rapidly. Finally, a fourth pre-charge circuit of the present invention comprises a single current source device that is capable of modifying its output current rapidly by selecting either a low or high current reference, thus being able to rapidly charge the OLED device.

FIG. 1 illustrates a schematic diagram of an OLED array circuit 100, which is representative of a portion of a typical common anode, passive matrix, large-screen OLED array and associated drive circuit. OLED array circuit 100 includes an OLED array 110 formed of a plurality of OLEDs 112 (each having an anode and cathode, as is well known) arranged in a matrix of rows and columns. For example, OLED array 110 is formed of OLEDs 112*a*, 112*b*, 112*e*, 112*d*, 112*e*, 112*f*, 112*g*, 112*h*, and 112*j* arranged in a 3×3 array, where the anodes of OLEDs 112*a*, 112*b*, and 112*c* are electrically connected to a ROW LINE 1, the anodes of OLEDs 112*d*, 112*e*, and 112*f* are electrically connected to a ROW LINE 2, and the anodes of OLEDs 112*g*, 112*h*, and 112*j* are electrically connected to a ROW LINE 3. Furthermore, the cathodes of OLEDs 112*a*, 112*d*, and 112*g* are electrically connected to a COLUMN LINE A, the cathodes of OLEDs 112*b*, 112*e*, and 112*h* are electrically connected to a COLUMN LINE B, and the cathodes of OLEDs 112*c*, 112*f*, and 112*j* are electrically connected to a COLUMN LINE C. Each OLED 112 represents a pixel in monochrome displays or a sub-pixel in a color display (typically red, green, or blue, however, any color variants are acceptable. Sub-pixels are geometrically grouped together to form single addressable full color pixels, for instance 112*a–c* may be respectively red, green and blue). An OLED emits light when forward biased in conjunction with an adequate current supply, as is well known.

A positive voltage ($+V_{LED}$), typically ranging between 5 volts (i.e., normal working voltage across the OLED+voltage over current source, usually 0.7 V) and 15–20 volts, is electrically connected to each respective row line ROW LINE 1, ROW LINE 2, ROW LINE 3 via a plurality of switches 114*a*, 114*b*, 114*e*. Switches 114*a*, 114*b*, 114*c* are conventional active switch devices, such as MOSFET switches or transistors having suitable voltage and current ratings. More specifically, a positive voltage $+V_{LED}$ is electrically connected to ROW LINE 1 via switch 114*a*, to ROW LINE 2 via switch 114*b*, and to ROW LINE 3 via switch 114*e*. Column lines COLUMN LINE A, COLUMN LINE B, and COLUMN LINE C are driven by separate constant current sources, i.e., a plurality of current sources ($I_{SOURCE}$) 116*a*, 116*b*, 116*c*. More specifically, current source $I_{SOURCE}$ 116*a* drives COLUMN LINE A, current source $I_{SOURCE}$ 116*b* drives COLUMN LINE B, and current source $I_{SOURCE}$ 116*c* drives COLUMN LINE C. Connected in series between current source $I_{SOURCE}$ 116*a* and ground is a switch 118*a*. Connected in series between current source $I_{SOURCE}$ 116*b* and ground is a switch 118*b*. Connected in series between current source $I_{SOURCE}$ 116*c* and ground is a switch 118*c*. Current sources $I_{SOURCE}$ 116*a*, 116*b*, 116*c* are conventional current sources capable of supplying a constant current typically in the range of 5 to 50 mA. Examples of constant current devices include a Toshiba TB62705 (8-bit constant current LED driver with shift register and latch functions) and a Silicon Touch ST2226A (PWM-controlled constant current driver for LED displays). Switches 118*a*, 118*b*, 118*c* are normally included in the current source integrated circuit and consist of a conventional active switch device, such as MOSFET switches or transistors having suitable voltage and current ratings.

The matrix of OLEDs 112*a*–112*j* within OLED array circuit 100 are arranged in the common anode configuration.

For each colour pixel for instance on ROW LINE 2, the anodes of each sub-pixel 112*d*–112*f* are all connected to the same row line. In this way the current source is referenced to the ground and the current and voltage are independent of one another providing better control of the light emission.

In operation, to activate (light up) any given OLED 112*a*–112*j*, its associated row line ROW LINE 1, ROW LINE 2, ROW LINE 3 and column line COLUMN LINE A, COLUMN LINE B, COLUMN LINE C are activated by simultaneously closing their associated switches 114*a*, 114*b*, 114*c* and 118*a*, 118*b*, 118*c*. In a first example, to light up OLED 112*b*, a positive voltage $+V_{LED}$ is applied to ROW LINE 1 by closing switch 114*a* and, simultaneously, a constant current is supplied to COLUMN LINE B via current source $I_{SOURCE}$ 116*b* by closing switch 118*b*. In this way, OLED 112*b* is forward biased and current flows through OLED 112*b*. Once a device threshold voltage (of typically 1.5–2 volts) across the OLED 112*b* is reached, the OLED 112*b* starts emitting light. OLED 112*b* remains lit up as long as switch 114*a* and switch 118*b* retrain closed. To deactivate OLED 112*b*, switch 118*b* is opened. In a second example, to light up OLED 112*g*, a positive voltage $+V_{LED}$ is applied to ROW LINE 3 by closing switch 114*c* and, simultaneously, a constant current is supplied to COLUMN LINE A via current source $I_{SOURCE}$ 116*a* by closing switch 118*a*. In this way, OLED 112*g* is forward biased and current flows through OLED 112*g*. Once the device threshold voltage (of typically 1.5–2 volts) across the OLED 112*g* is reached, OLED 112*g* starts emitting light. OLED 112*g* remains lit up as long as switch 114*c* and switch 118*a* remain closed. To deactivate OLED 112*g*, switch 118*a* is opened.

Along a given row line ROW LINE 1, ROW LINE 2, ROW LINE 3, any one or more OLEDs 112*a*–112*j* may be activated at any given time. By contrast, along a given column line COLUMN LINE A, COLUMN LINE B, COLUMN LINE C, only one OLED 112 may be activated at any given time. Thus, a complete image is built from sequentially or randomly selecting each row of OLED array 110, by closing its corresponding switch 114*a*–114*c*. In each row a current with a certain intensity and a certain duration is sent through the diodes 112*a*–112*c*, 112*d*–112*f*, 112*g*–112*j* on that row by current sources 116*a*, 116*b*, 116*e* by closing and opening switches 118*a*, 118*b*, 118*c*, such as to display the correct intensity in each pixel or sub-pixel. A switch 114*a*, 114*b*, 114*c* remains closed as long as its row is selected and opens when the next row is selected. All switches 118*a*, 118*b*, 118*c* open before the next row is selected. Further details of the operation of any given OLED 112*a*–112*j* is found in reference to FIGS. 2A and 2B below.

Figure 2A:
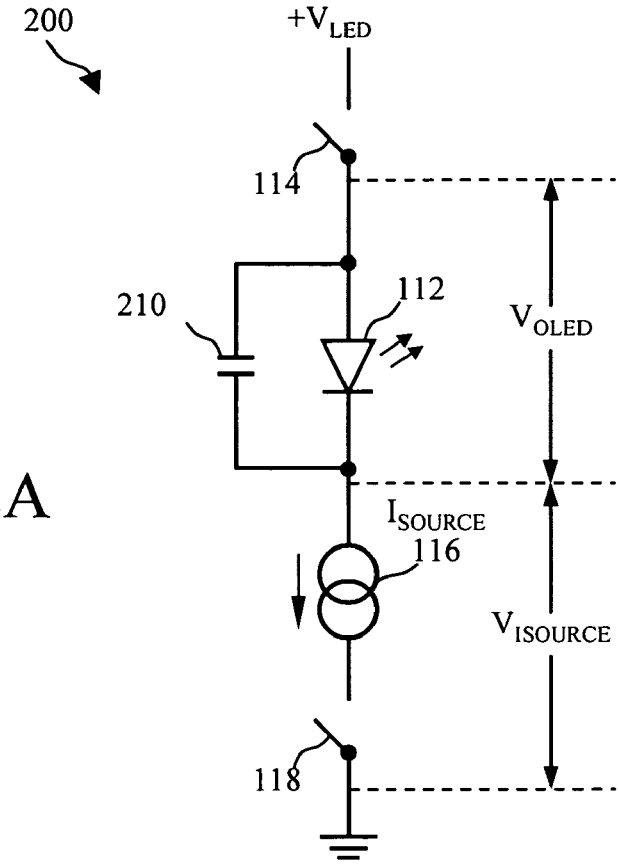

FIG. 2A illustrates a schematic diagram of an OLED drive circuit 200, which is representative of a typical drive circuit of a single OLED 112 within OLED array circuit 100 of FIG. 1. OLED drive circuit 200 includes switch 114, OLED 112, current source $I_{SOURCE}$ 116, and switch 118 all arranged in series between positive voltage $+V_{LED}$ and ground as shown in FIG. 2A. OLED drive circuit 200 further includes a capacitor 210 arranged in parallel with OLED 112. Capacitor 210 is representative of the device capacitance ($C_{OLED}$) of OLED 112. Given the area of the structure of OLED 112, a typical value of $C_{OLED}$ can be more than 500 pF, which is relatively high compared with a usual $C_{OLED}$ value of 5 pF for a small OLED structure used in a small-screen OLED display application. The value of $C_{OLED}$ along with any additional line capacitance of the physical package, which for the purpose of this description are assumed to be negligible, must be overcome in order to achieve satisfactory display performance. A voltage $V_{OLED}$ represents the voltage potential across OLED 112 and a voltage $V_{ISOURCE}$ represents the voltage potential across the series-connected current source $I_{SOURCE}$ 116 and switch 118.

Figure 2B:
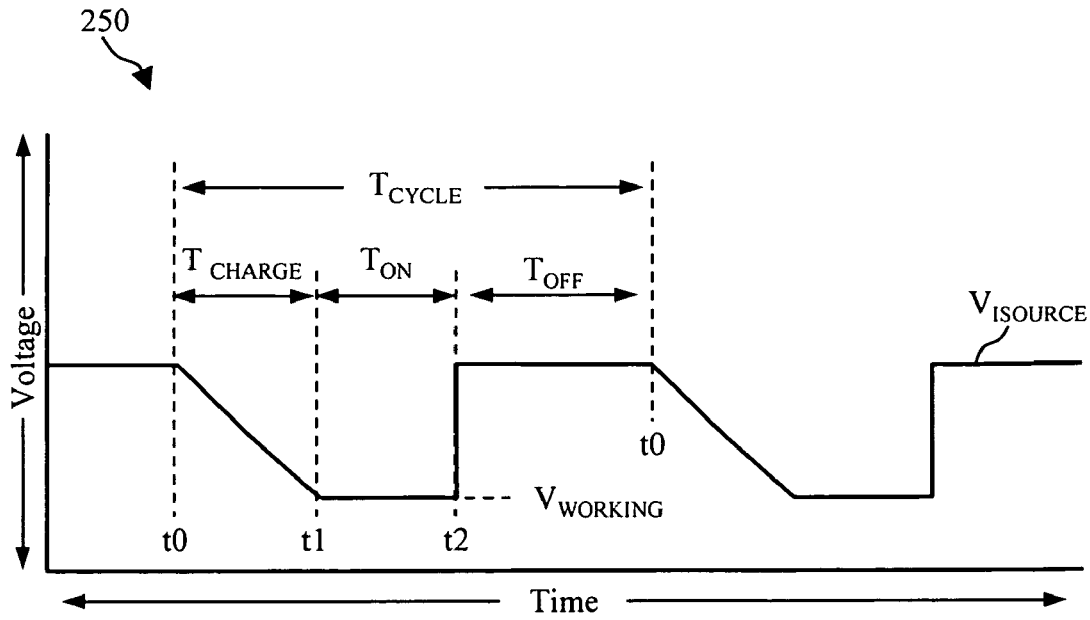
FIG. 2B shows a plot of $V_{ISOURCE}$, thereby illustrating the operation of the OLED drive circuit of FIG. 2A.

FIG. 2B shows a plot 250 of the voltage potential $V_{ISOURCE}$ across the series-connected current source 116 and switch 118, from a time t0, when switches 114 and 118 are closed, to a time t2, when switch 118 is opened, thereby illustrating the operation of OLED drive circuit 200. At time t0, the value of $V_{ISOURCE}$ is equal to positive voltage $+V_{LED}$ and begins to fall slowly towards the working voltage ($V_{WORKING}$) of OLED 112 due to the relatively high capacitance value $C_{OLED}$ of the OLED 112. The OLED starts lighting up a little bit as soon as the threshold level or threshold voltage is reached (the threshold voltage of an OLED is the voltage across the OLED just enough to let it light up; the normal operating voltage or working voltage across the OLED is higher than this threshold voltage). $V_{ISOURCE}$ reaches the working voltage of OLED 112 at a time t1. The period between t0 and t1 represents the charge time $T_{CHARGE}$ of capacitor 210 of OLED 112. The voltage transition from t0 to t1 is linear because the current output of current source $I_{SOURCE}$ 116 is constant. At time t1, OLED 112 begins to emit its full light and continues to emit light for a predetermined period of time which is the OLED emission time $T_{ON}$ as long as switches 114 and 118 remain closed. OLED 112 is deactivated by opening switch 118, and subsequently $V_{ISOURCE}$ returns sharply to the $+V_{LED}$ value. OLED 112 remains off for a period from t2 to the next t0, i.e., OLED off time or period $T_{OFF}$. Therefore, a cycle time $T_{CYCLE}$ is represented by $T_{CHARGE}+T_{ON}+T_{OFF}$. As shown in plot 250, $T_{CHARGE}$ represents time wasted when switches 114 and 118 are closed and capacitor 210 is charging but OLED 112 is not yet emitting light at the desired emission level. This results in an extended $T_{CYCLE}$, thereby decreasing the achievable $T_{ON}/T_{OFF}$ rate and limiting the achievable performance of OLED drive circuit 200. FIGS. 3A, 3B, 4, 5, and 6 that follow illustrate ways to minimize or eliminate the $T_{CHARGE}$ time by performing a pre-charge operation on capacitor 210, thereby minimizing $T_{CYCLE}$.

Figure 3A:
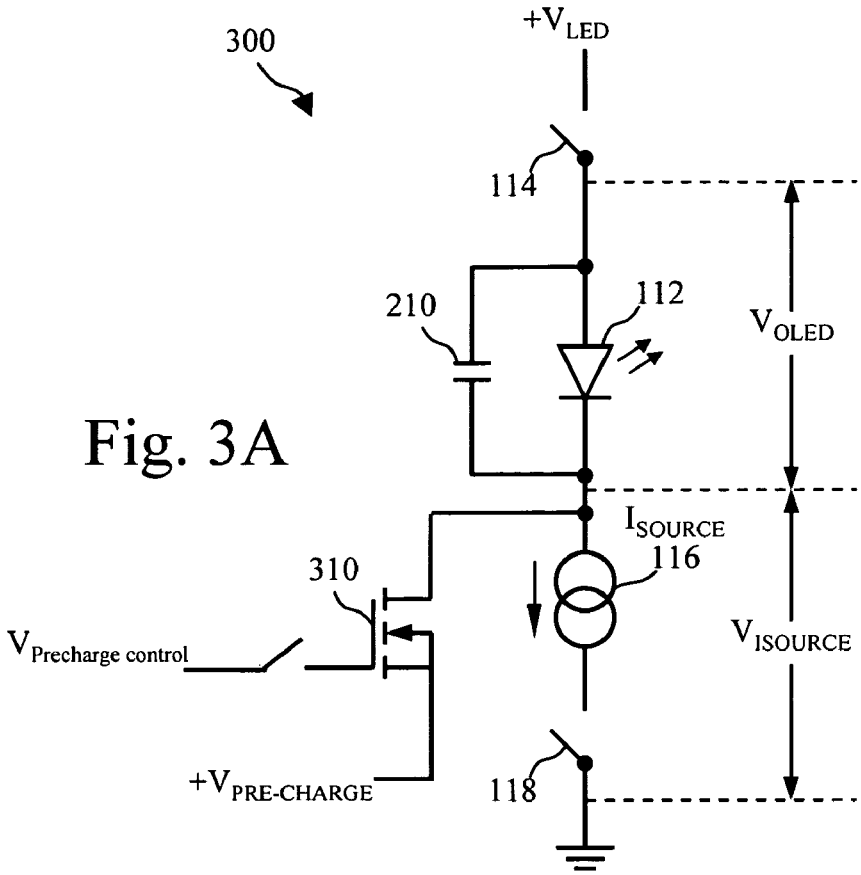
FIG. 3A illustrates a schematic diagram of an OLED pre-charge circuit in accordance with a first and preferred embodiment of the present invention.

FIG. 3A illustrates a schematic diagram of an OLED pre-charge circuit 300 in accordance with a first and preferred embodiment of the invention. OLED pre-charge circuit 300 is identical to OLED drive circuit 200 of FIG. 2A except for the addition of a MOSFET 310 arranged in parallel with current source $I_{source}$ 116. More specifically, the drain of MOSFET 310 is electrically connected directly to the cathode of OLED 112, the source of MOSFET 310 is connected to a pre-charge voltage$+V_{PRE\text{-}CHARGE}$, and the gate of MOSFET 310 is electrically connected to a pre-charge control voltage $V_{PRECHARGE\text{-}CONTROL}$. MOSFET 310 may be any conventional NMOS transistor device having suitable voltage and current ratings for this application. However, MOSFET 310 is representative of any suitable active switch device.

Figure 3B:
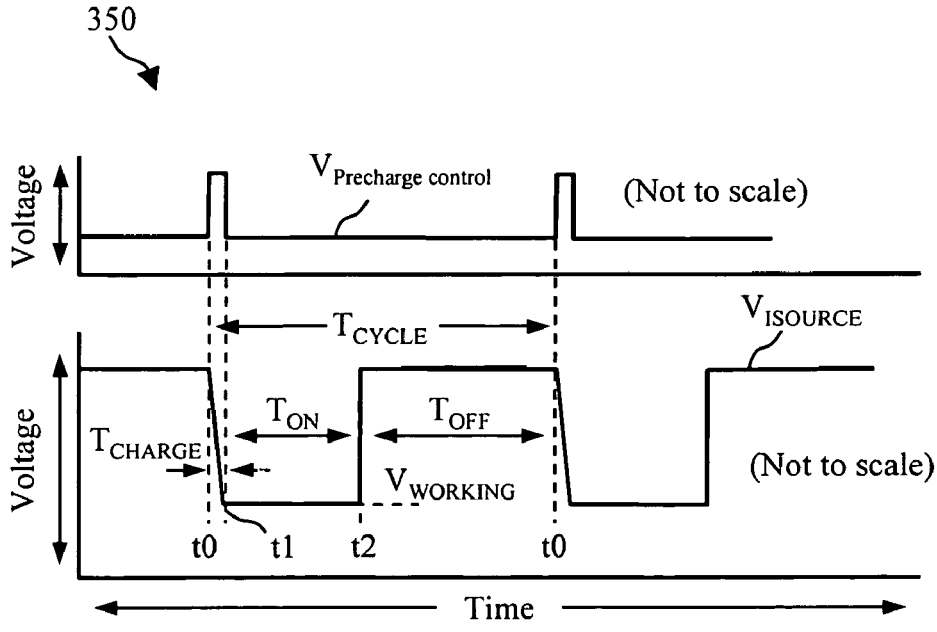
FIG. 3B shows a plot of $V_{ISOURCE}$ VS. $+V_{PRE\text{-}CHARGE}$, thereby illustrating the operation of OLED the pre-charge circuits of FIGS. 3A, 4, 5, and 6.

FIG. 3B shows a plot 350 of $V_{ISOURCE}$ vs. $+V_{PRE\text{-}CHARGE}$ from a time t0, when the pre-charge operation begins, to a time t2, when switch 118 is opened, thereby illustrating the operation of OLED pre-charge circuit 300. (It is to be noted that the plot of $V_{ISOURCE}$ vs. $+V_{PRE\text{-}CHARGE}$ is not drawn to scale in relation to one another along the voltage axis. Plot 350 is intended to illustrate only general voltage transitions and timing.) At tune t0, MOSFET 310 is switched on by applying a voltage $V_{PRECHARGE\text{-}CONTROL}$ its gate, which voltage $V_{PRECHARGE\text{-}CONTROL}$ is positive enough referred to the source of MOSFET 310 (voltage=$+V_{PRECHARGE}$) to saturate MOSFET 310. MOSFET 310 connects a source that is able to sink typically 100 to 600 ma of current. In addition, at time t0 switch 114 is closed, while switch 118 remains open. As a result, current begins to flow through OLED 112 for a short period of time via the electrical path created by MOSFET 310. This time period must be long enough to build up a voltage across capacitor 210 of OLED 112 that approaches the working voltage of OLED 112. Once this voltage has built up across capacitor 210 of OLED 112, MOSFET 310 is switched off, i.e., the $+V_{PRE\text{-}CHARGE}$ voltage at the cathode of the OLED is removed, and switch 118 is simultaneously closed, thereby allowing the normal operating current from current source (SOURCE 116 to flow through OLED 112, causing light to be emitted.

Plot 350 of FIG. 3B shows that the value of $V_{ISOURCE}$ is equal to $+V_{LED}$ at t0 when $V_{PRECHARGE\text{-}CONTROL}$ is applied (MOSFET 310 on), switch 114 is closed, and switch 118 is open. Subsequently, $V_{ISOURCE}$ falls sharply toward the working voltage of OLED 112 due to $+V_{PRE\text{-}CHARGE}$ rapidly charging capacitor 210. At t1, $V_{PRECHARGE\text{-}CONTROL}$ is removed and switch 118 is closed. The period between t0 and t1 represents the charge time $T_{CHARGE}$ of capacitor 210 of OLED 112. At time t1, OLED 112 begins normal light emission and continues to emit light for a predetermined period of time $T_{ON}$ as long as switches 114 and 118 remain closed. Thus, switch 114 is closed for a period of time equal to at least charge time $T_{CHARGE}$+OLED emission time $T_{ON}$, while switch 118 is closed for a period of time equal to the OLED emission time $T_{ON}$. OLED 112 is deactivated by opening switch 118, and subsequently $V_{ISOURCE}$ returns sharply to the $+V_{LED}$ value. OLED 112 remains off for a period from t2 to the next t0, i.e., OLED off tune $T_{OFF}$. Therefore, a cycle time $T_{CYCLE}$ is represented by $T_{CHARGE}+T_{ON}+T_{OFF}$.

With reference to plot 250 of FIG. 2A and plot 350 of FIG. 3A, it is illustrated that charge time $T_{CHARGE}$ of OLED pre-charge circuit 300, which is typically in the range of 12 ns to 50 ns, is significantly minimized compared with the charge time $T_{CHARGE}$ of OLED drive circuit 200, which is typically in the range of 25 ns to 65 μs. As a result, $T_{CYCLE}$ of OLED pre-charge circuit 300 is allowed to be significantly shorter than $T_{CYCLE}$ of OLED drive circuit 200 while achieving equivalent $T_{ON}$ time. Consequently, the achievable $T_{ON}/T_{OFF}$ rate of OLED 112 within OLED pre-charge circuit 300 is increased compared with the achievable on/off rate of OLED 112 within OLED drive circuit 200, thereby enhancing overall performance.

Is it important to balance the operation of OLED pre-charge circuit 300 such that charge time $T_{CHARGE}$ is minimized while also ensuring that pre-charging stops when the working voltage of OLED 112 has been reached. Consequently, if the timing of the pre-charging is too long, it will result in an excessive current through OLED 112, which results in excessive light emission. As a precaution, it may be desirable to end the pre-charge operation just short of $V_{ISOURCE}$ reaching the normal operating voltage of 0.7 volts. For example, $V_{PRECHARGE\ CONTROL}$ Can be removed when $V_{ISOURCE}$ reaches 1.5 volts. This would result in a slightly longer charge time $T_{CHARGE}$, as the voltage transition from 1.5 to 0.7 volts is due to the current supplied by current source $I_{SOURCE}$ 116 only, without the help of $+V_{PRE\text{-}CHARGE}$.

Furthermore, when the OLED emission time $T_{ON}=0$, the pre-charge operation must not occur, so that OLED 112 is not lighted up when it is unwanted. In this case, both switch 118 and MOSFET 310 remain open. If the pre-charge operation was allowed when OLED emission time $T_{ON}=0$, OLED 112 could possibly begin lighting up because $+V_{PRE\text{-}CHARGE}$ reaches a level just high enough to slightly light up OLED 112.

Thus, unwanted lighting of OLED 112 should be avoided by eliminating the pre-charge operation if OLED emission time $T_{ON}=0$.

In summary, and in reference to FIGS. 3A and 3B, just prior to the desired $T_{ON}$ time, a pre-charge voltage ($V_{PRE\text{-}CHARGE}$) from a source that is able to sink a suitable amount of current is applied to the OLED cathode via MOSFET 310. Thus, capacitor 210 is charged rapidly, not via the normal current source ($I_{SOURCE}$ 116), but instead via a high current through MOSFET 310.

Figure 4:
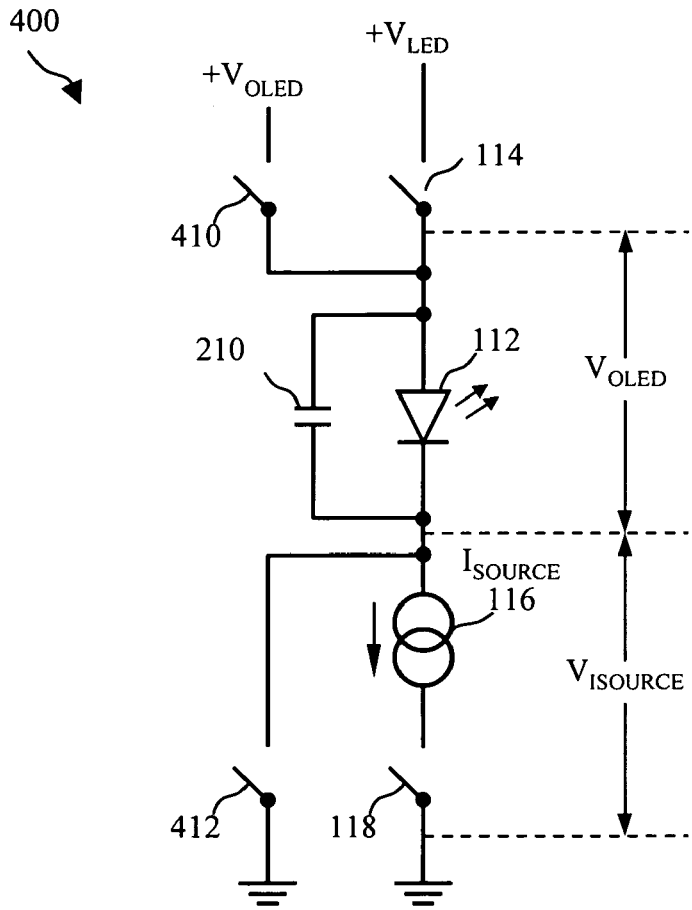
FIG. 4 illustrates a schematic diagram of an OLED pre-charge circuit in accordance with a second embodiment of the present invention.

FIG. 4 illustrates a schematic diagram of an OLED pre-charge circuit 400 in accordance with a second embodiment of the invention. OLED pre-charge circuit 400 is identical to OLED drive circuit 200 of FIG. 2 except that a voltage $V_{OLED}$ may be electrically connected to the anode of OLED 112 via a switch 410, and the cathode of OLED 112 may be electrically connected to ground via a switch 412. Switches 410 and 412 are conventional active switch devices, such as MOSFET switches or transistors having suitable voltage and current ratings.

In operation, just prior to the desired OLED emission time $T_{ON}$ (see FIG. 3B) the anode of OLED 112 is forced to the normal operating voltage across the OLED 112 ($V_{OLED}$) for a short time by closing switch 410, while concurrently shorting the cathode of OLED 112 to ground by closing switch 412. In this way, a charge is built up across capacitor 210 rapidly. After a predetermined amount of time (i.e., charge time $T_{CHARGE}$ of FIG. 3B), switches 114 and 118 are closed and switch 412 is opened, thereby applying $+V_{LED}$ to the anode of OLED 112 and supplying the normal operating current via current source $I_{SOURCE}$ 116. As a result, OLED 112 begins its normal operation (i.e., $T_{ON}$ of FIG. 3B).

Similar to OLED pre-charge circuit 300 of FIG. 3A, $T_{CHARGE}$ of OLED pre-charge circuit 400, which is typically in the range of 12 ns to 50 ns, is significantly minimized compared with charge time $T_{CHARGE}$ of OLED drive circuit 200, which is typically in the range of 25 ns to 65 μ*s*. A*s* a *result*, $T_{CYCLE}$ of OLED pre-charge circuit 400 is allowed to be significantly shorter than $T_{CYCLE}$ of OLED drive circuit 200 while achieving equivalent OLED emission time $T_{ON}$. Consequently, the achievable $T_{ON}/T_{OFF}$ rate of OLED 112 within OLED pre-charge circuit 400 is increased compared with the achievable on/off rate of OLED 112 within OLED drive circuit 200, thereby enhancing overall performance.

In summary, and in reference to FIG. 4, just prior to the desired OLED emission time $T_{ON}$, a pre-charge voltage ($+V_{OLED}$) is applied to the anode of OLED 112 while, concurrently, the cathode of OLED 112 is pulled to ground; thus, capacitor 210 is charged rapidly, not via the normal current source ($I_{SOURCE}$ 116), but instead via $+V_{OLED}$ and the straight connection of the cathode to the ground.

Figure 5:
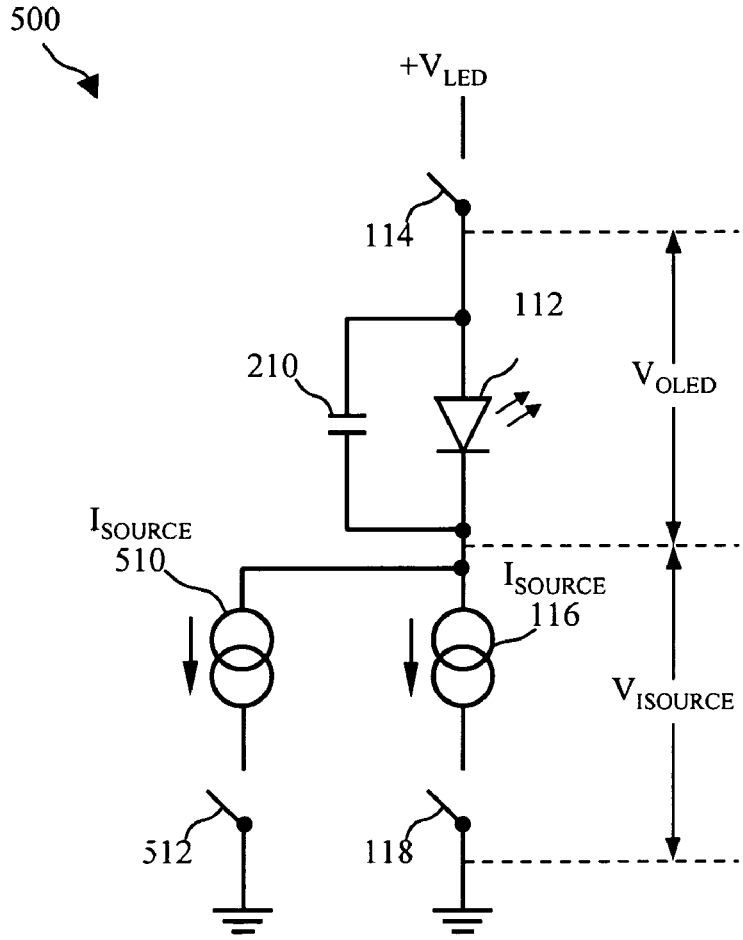
FIG. 5 illustrates a schematic diagram of an OLED pre-charge circuit in accordance with a third embodiment of the present invention.

FIG. 5 illustrates a schematic diagram of an OLED pre-charge circuit 500 in accordance with a third embodiment of the invention. OLED pre-charge circuit 500 is identical to OLED drive circuit 200 of FIG. 2, except that an additional current source (i.e., a current source $I_{SOURCE}$ 510 with an associated series-connected switch 512) is connected in parallel with current source $I_{SOURCE}$ 116, as shown in FIG. 5. Current source $I_{SOURCE}$ 510 is a conventional current source capable of supplying a constant current typically in the range of 100 to 600 mA. Switch 512 is a conventional active switch device, such as a MOSFET switch or transistor having suitable voltage and current ratings.

In operation, just prior to the desired $T_{ON}$ time (see FIG. 3B) switches 114, 118 and 512 are all closed, thus additional current is available via current source $I_{SOURCE}$ 510 along with the normal current supplied via current source $I_{SOURCE}$ 116. As a result of the additional current availability, the charge time (i.e., $T_{CHARGE}$ of FIG. 3B) of capacitor 210 is reduced. In this way, a charge is built up across capacitor 210 rapidly. After a predetermined amount of time (i.e., $T_{CHARGE}$ of FIG. 3B), switch 512 is opened, thereby allowing only the normal operating current via current source $I_{SOURCE}$ 116. As a result, OLED 112 begins its normal operation (i.e., $T_{ON}$ of FIG. 3B).

Similar to OLED pre-charge circuit 300 of FIG. 3A and OLED pre-charge circuit 400 of FIG. 4, charge time $T_{CHARGE}$ of OLED pre-charge circuit 500, which is typically in the range of 12 ns to 50 ns, is significantly minimized compared with charge time $T_{CHARGE}$ of OLED drive circuit 200, which is typically in the range of 25 ns to 65 μs. As a result, $T_{CYCLE}$ of OLED pre-charge circuit 400 is allowed to be significantly shorter than $T_{CYCLE}$ of OLED drive circuit 200 while achieving equivalent OLED emission time $T_{ON}$. Consequently, the achievable $T_{ON}/T_{OFF}$ rate of OLED 112 within OLED pre-charge circuit 500 is increased compared with the achievable on/off rate of OLED 112 within OLED drive circuit 200, thereby enhancing overall performance.

In summary, and in reference to FIG. 5, just prior to the desired $T_{ON}$ time, capacitor 210 is charged rapidly, not via the normal current source ($I_{SOURCE}$ 116) only, but with the additional current available to OLED 112 via current source $I_{SOURCE}$ 510.

The charge time $T_{CHARGE}$ used for pre-charge, greatly influences the performance of a display. Longer pre-charge times $T_{CHARGE}$, limit the maximum light output while compensating by increasing the current level increases the lowest light output and thus eliminates gray scales. High quality displays need a large number of gray scales, thus requiring a high digital resolution or number of possible output values or current sources operating at high clock speeds. A single current pulse (one clock cycle) will only generate light if the threshold is reached within that pulse, for instance in half the time of a clock cycle. If $f_c$ is the clock frequency, then the shortest t2–t0 is $1f_c$. For example a 40 MHz clock, the pre-charge time $T_{CHARGE}$ would then have to be as short as 12 ns. For OLED diodes typically operating in the range of 9–15 V and a large $C_{OLED}$ of 500 pF, a pre-charge current of at least 375 mA ($C_{OLED}$*dV/dt) is required, which is quite high. However, the requirement of reaching the pre-charge state within a clock pulse period maybe overcome by using two current sources 116, 510 as in FIG. 5.

Figure 5A:
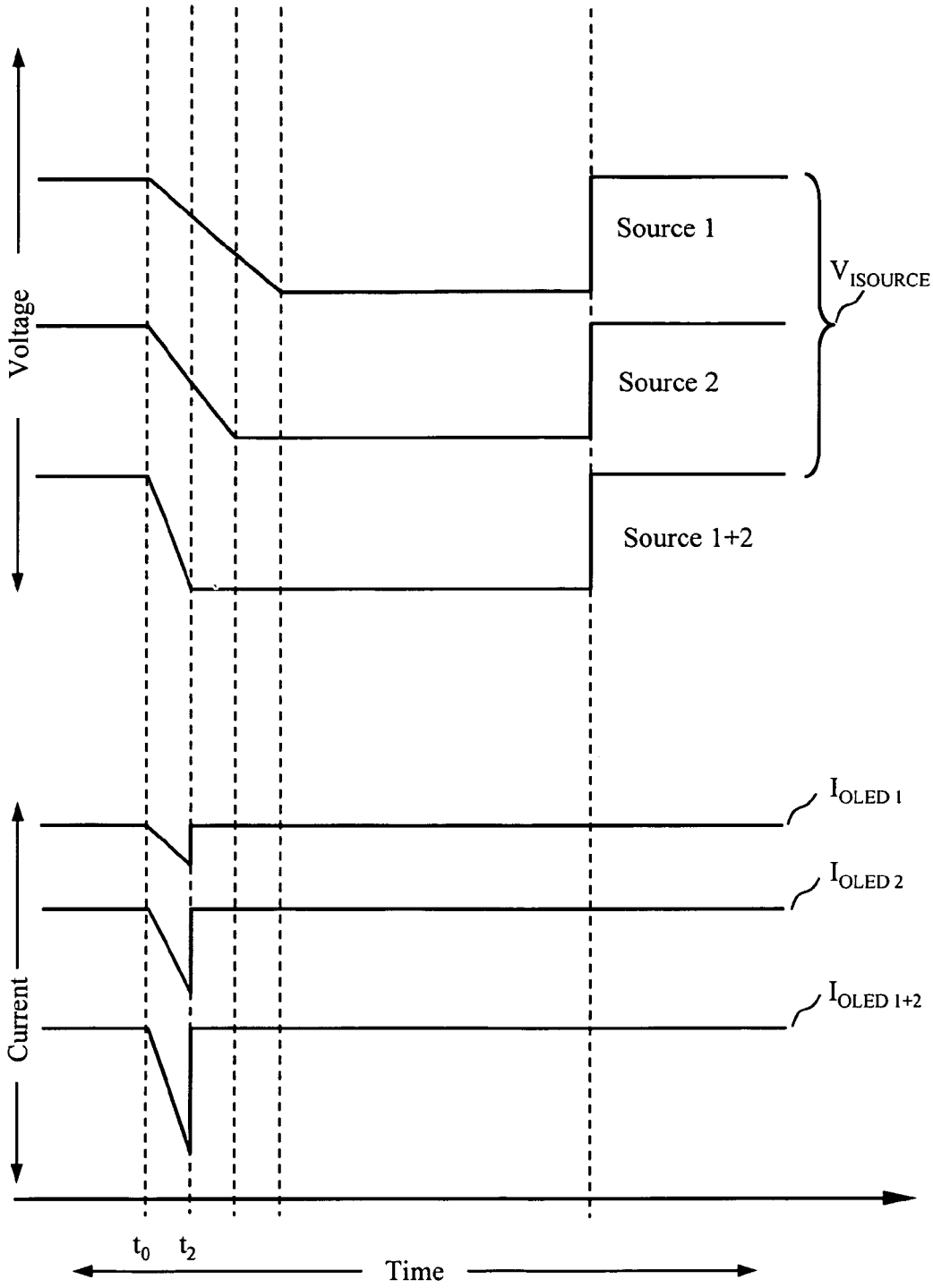
FIG. 5A illustrates the result on voltage and current in function or time, of using two current sources as in FIG. 5

FIG. 5A, demonstrates the possible result of using two current sources 116 and 510 as in FIG. 5. Current source 510 is for instance capable of delivering twice the current of current source 116. That means that $V_{ISOURCE}$ of current source 510 reaches the threshold voltage in half the time of $V_{ISOURCE}$ of current source 116. Consequently, when both current sources 510, 116 operate simultaneously, $V_{ISOURCE}$ will reach the threshold in a third of the time. In the lower part of FIG. 5A, corresponding currents $I_{OLED}$ through the OLED 112 are shown for a t1–t0 equal to the time required for the two current sources 510, 116 to together reach the threshold. The surface under the current curve is a measure for the emitted light. As can be seen, even though $V_{ISOURCE}$ for each current source 510, 116 separately does not necessarily reach the threshold within the on time, three possible light output values are generated as long as the reached $V_{OLED}$ (not drawn in FIG. 5A) is high enough for the diode 112 to start emitting light. Expanding on this principle, at low light output values highly precise gray scales can be obtained by varying the on time of one or two current sources 510, 116. Additionally, high current can be obtained at high light output by switching on both current sources 510, 116.

FIG. 6 illustrates a schematic diagram of an OLED pre-charge circuit 600 in accordance with a fourth embodiment of the invention. OLED pre-charge circuit 600 is identical to OLED drive circuit 200 of FIG. 2, except that current source $I_{SOURCE}$ 116 is replaced with a current source $I_{SOURCE}$ 610, which is a single current source device that is capable of modifying its output current rapidly by selecting either a low or high current reference via a switch 612 and a switch 614, respectively. Switches 612 and 614 are conventional active switch devices, such as MOSFET switches or transistors having suitable voltage and current ratings.

In operation and with reference to FIGS. 3B and 6, during charge time $T_{CHARGE}$ switches 114, 118 and 612 are closed and switch 614 is open, thereby supplying the high current reference to current source $I_{SOURCE}$ 610 and thus charging capacitor 210 rapidly. Once the pre-charge operation is complete, switch 612 is opened and switch 614 is closed, thereby supplying the low current reference to current source $I_{SOURCE}$ 610. As a result, current source $I_{SOURCE}$ 610 rapidly drops to the normal constant operating current. Switches 114, 118, and 614 remain closed for the duration of OLED emission time $T_{ON}$ and normal operation occurs. At time t2 switch 118 is opened, thus ending OLED emission time $T_{ON}$.

Lastly, because the pre-charge circuits of the present invention overcome the adverse performance effects due to $C_{OLED}$, any process variations affecting $C_{OLED}$ do not factor into the OLED overall display performance. Thus, the pre-charge circuits of the present invention eliminate the effects of varying OLED device characteristics, such as capacitance, due to manufacturing process variations.

The invention claimed is:

1. Drive circuitry for a common anode, passive matrix, organic light-emitting diode (OLED) display comprising at least one OLED having an anode and a cathode, the cathode of the OLED being coupled in series to a first current source and a first switching means, and the anode of the OLED being coupled in series to a second switching means, wherein the drive circuitry is adapted so that one cycle for the at least one OLED consists of a charge time of the OLED which starts with the voltage between the cathode and anode of the OLED being zero, followed by pre-charging the at least one OLEO to a strictly positive voltage level before closing the first switching means, followed by maintaining a working voltage for the ON-time, followed by an OFF-time in which the cathode voltage returns to the voltage at the anode after which the cycle is repeated.

2. Drive circuitry according to claim 1, wherein the means for pre-charging the at least one OLED comprises a third switching means.

3. Drive circuitry according to claim 2, wherein the third switching means comprises an active switch device.

4. Drive circuitry according to claim 3, wherein the active switch device comprises a MOSFET.

5. Drive circuitry according to claim 4, wherein the MOSFET is an NMOS transistor device having suitable voltage and current ratings for pre-charging the at least one OLED.

6. Drive circuitry according to claim 2, wherein the third switching means is coupled in a branch in parallel over the first current source.

7. Drive circuitry according to claim 4, the MOSFET having a source, wherein the source is electrically connected to a pre-charge voltage.

8. Drive circuitry according to claim 7, the MOSFET having a drain, wherein the drain of the MOSFET is electrically connected to the cathode of the OLED.

9. Drive circuitry according to claim 2, wherein the third switching means comprises a first switch device suitable for coupling the cathode of the OLED to the ground, and a second switch device suitable for coupling the anode of the OLED to a voltage supply substantially corresponding to the normal operating voltage of the OLEO.

10. Drive circuitry according to claim 9, wherein the first switch device and the second switch device are active switch devices.

11. Drive circuitry according to claim 10, wherein the active switch devices are MOSFET transistors having suitable voltage and current ratings for pre-charging the at least one OLED.

12. Drive circuitry according to claim 2, wherein the means for pre-charging the at least one OLED furthermore comprises a second current source coupled in parallel over the first current source.

13. Drive circuitry according to claim 12, wherein the second current source is suitable for supplying a current between 50 and 800 mA.

14. Drive circuitry according to claim 12, wherein the second current source is substantially identical to the first current source.

15. Drive circuitry according to claim 12, wherein the second current source is suitable for supplying a current between 2 and 4 times the current supplied by the first current source.

16. Drive circuitry according to claim 2, wherein the first current source is a current source device capable of modifying its output current by selecting either one of a first or a second current reference.

17. An arrangement comprising:

an array of OLEDs, each OLED having an anode common with other OLED's of the array and a cathode, and drive circuitry according to claim 1.

18. A common anode, passive matrix, organic light-emitting diode (OLED) display comprising an array of OLEDs, each OLED having an anode and a cathode, the display comprising drive circuitry according to claim 1.

19. A method for pre-charging an organic light emitting diode (OLED) of a common anode, passive matrix OLED display prior to a desired ON-time of the OLED, one cycle for the OLED consisting of a charge time of the OLED which starts with the voltage between the cathode and anode of the OLED being zero, charging the OLED to a strictly positive voltage level immediately prior to the desired ON-time, followed by maintaining the working voltage for the ON-time, followed by an OFF-time in which the cathode voltage returns to the voltage at the anode, after which the cycle is repeated, wherein the charging is done by applying a pre-charge voltage to the cathode of the OLED prior to the desired ON-time.

20. A method according to claim 19, wherein the pre-charge voltage is substantially equal to a normal operating voltage of the OLED during ON-time.

21. A method for pre-charging according to claim 20 and where at low light output extra gray scales are obtained by selectively switching two current sources.

* * * * *